United States Patent [19]

Krubsack

[11] Patent Number: 4,521,758

[45] Date of Patent: Jun. 4, 1985

[54] ELECTRIC SOLENOID STRUCTURE

[75] Inventor: Larry J. Krubsack, Colgate, Wis.

[73] Assignee: Clum Mfg. Co. Inc., Hartland, Wis.

[21] Appl. No.: 527,236

[22] Filed: Aug. 29, 1983

[51] Int. Cl.[3] ..... H01H 50/02

[52] U.S. Cl. ..... 335/131; 335/126; 335/255

[58] Field of Search ..... 335/131, 202, 157, 193, 335/277, 278, 126, 255

[56] References Cited

U.S. PATENT DOCUMENTS 4,293,835 10/1981 Davis et al. ..... 335/131

*Primary Examiner*—E. A. Goldberg
*Assistant Examiner*—George Andrews
*Attorney, Agent, or Firm*—Andrus, Sceales, Starke & Sawall

[57] ABSTRACT

An electric starter solenoid for starting internal combustion engines includes a housing having a lower coil section and an outer rectangular contact section. The coil section has a hexagonal cross-section and a depth to receive an annular coil unit. An armature is journaled in the coil unit. A contact guide with spaced terminals to the opposite ends in the upper section. A floating contact plate is resiliently mounted on a guide pin and guided in the rectangular section. The guide pin engages the armature. A light spring urges the guide pin against the armature in spaced relation to the terminals. The coil unit includes a bottom plate with opposite projection mating with corners of the housing to angularly orient the coil unit in the housing. In one unit, a common coil lead is connected to the bottom plate. A mounting plate is secured to the open housing end with a coil spring between the metal plate and the closure plate to clamp the coil within the housing and simultaneously provides an electrical connection between the common side of the coil and the mounting plate. In an alternate structure, the housing is closed by a hexagonal cover which clamps the coil in plate. The housing and the cover include complementing clamping means to clamp the coil leads in position for connection of the coil to an appropriate circuitry. The coil leads may be connected to one or more external terminals on the housing or to a separate circuit connection in an integral housing.

13 Claims, 9 Drawing Figures

ELECTRIC SOLENOID STRUCTURE

BACKGROUND OF THE PRESENT INVENTION

This invention relates to a solenoid for selectively closing the connection between a pair of fixed terminals, with one particular application being the energizing of electric starter motors used in various internal combustion engine driven devices.

In addition to automobiles and trucks, other labor saving devices such as lawn mowers, garden tractors, snow blowers and other similar devices are powered by an internal combustion engine. The lower horsepower engines may be provided with a manual starter unit or a motor-driven electric starter unit. If an electric starter unit is provided, a solenoid is used to complete the starting circuit from the battery to the starting motor. The solenoid is controlled by a remote start circuit. In these low horsepower engine applications, the total cost of the device does not permit the use of a relatively large and expensive solenoid structure as used on automobiles and like vehicles.

Although the solenoid should be of a relatively inexpensive construction, the rather severe weather conditions and high levels of vibration and shock demand the solenoid be ruggedly built to provide economic durability. The solenoid structure should be as compact as practical due to the relatively confined space in the engine compartment.

Although various units have been suggested, there is a distinct need for a small, compact and relatively inexpensive solenoid for use in engine starters and other applications.

SUMMARY OF THE PRESENT INVENTION

The present invention is particularly directed to a small, compact and relatively inexpensive solenoid adapted for electric starter motors used on low horsepower internal combusion engine applications. The present invention is particularly described in connection with application as a starter solenoid, but the present invention may of course be used in applications where a low power circuit controls a high power circuit. Generally in accordance with the present invention, the solenoid includes a molded plastic housing having a coil section for receiving an annular electro-magnetic coil unit and specially shaped for optimum confining and orientation of the coil unit and an integral contact section specially shaped for confined movement of a bridging contact assembly for selectively open and closing the circuit between a pair of fixed power terminals.

More particularly, in accordance with the present invention, the lower coil housing section is formed with a special configuration and preferably a hexagonal cross-section to define an open ended housing of a minimum diameter to accept the annular coil unit. The coil unit includes an outer magnetic shell and a clamping plate having at least one lateral projection. The plate is coupled to the coil bobbin and includes at least one lateral projection which interfits with the housing to prevent rotation of the coil assembly and thereby maintains the coil connections in relatively fixed orientation within the housing.

In one embodiment, the ground lead of the coil is connected to the metal clamping plate. A coil spring is placed between the clamping plate and a metal mounting plate to establish an electrical connection of the coil to the mounting plate and simultaneously to resiliently urge and clamp the coil assembly in the housing.

The mounting plate or cover plate can be fixed to the housing by riveting, screwing, glueing or any other fastening means. The second lead of the coil is connected to a coil terminal in an extended flange of the plastic housing. The coil terminal can be a suitable threaded bolt of any thread size and length or other connection device, such as a Faston connector, depending upon the final application of the solenoid.

In another embodiment, both coil leads are connected to coil terminals in the extended flange of the plastic housing. In this embodiment, the one coil lead is not connected to the clamping plate.

In another embodiment, the coil leads are externally connected directly to a circuit board. The lower end of the housing in this instance does not provide for grounding. The housing is recessed to receive an insulating sealing plate with a shape corresponding essentially to the shape of the housing opening. The housing exit wall edge and the closure plate have complementing recesses and projections for clamping the coil leads in fixed relation to the housing.

In another embodiment, one coil lead is connected to a wire extension which exits from the housing for external connection. The second coil lead is connected to a suitable connector such as a Faston terminal which protrudes from the housing. The housing is recessed to receive an insulating sealing plate with a shape corresponding essentially to the shape of the housing opening.

The contact section of the housing is formed as a central rectangular extension, preferably with an external intermediate center wall extended transversely of the rectangular section. Fixed terminals are secured within the opposite ends of the top wall of the rectangular section. The fixed terminals can be suitable bolt-like members of any thread size and length depending upon the final application of the solenoid. A contact unit including a rectangular bridging contact is mounted on a guide pin. The bridging contact is of a sufficient length to span the distance between the fixed terminals and is of a lateral width generally corresponding to the internal width of the rectangular housing. The bridging contact is thus guided for movement within the housing. The bridging contact is mounted on an insulating guide pin between a pair of pin abutments and with a spring to the opposite side of the contact to resiliently load the contact for movement on the pin. The guide pin projects into the coil assembly and is coupled to the armature. A stabilizing coil spring interposed between the guide pin and the head of the rectangular section urges the guide pin into engagement with the armature.

The present invention provides a small, compact solenoid particularly adapted for application in high vibration environments while maintaining a long life as a result of the controlled mounting of the coil and the movable contacts. Further, the apparatus is readily constructed of a minimum number of components and subassemblies, which can be separately formed and assembled in a production line.

DESCRIPTION OF THE DRAWING FIGURES

The accompanying drawings illustrate the best mode presently contemplated by the inventor for carrying out the invention.

In the drawings

DESCRIPTION OF THE ILLUSTRATED EMBODIMENT

Figure 1:
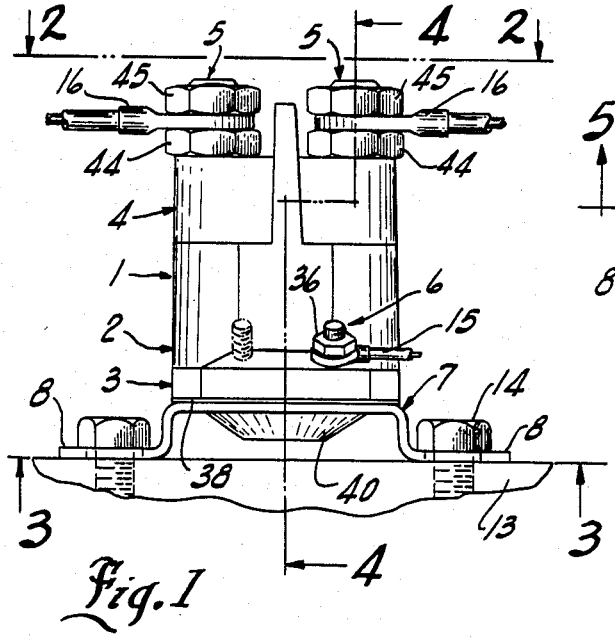
FIG. 1 is a perspective view of a solenoid constructed in accordance with the teaching of the present invention.

Referring to the drawings and particularly to FIGS. 1-6, a solenoid 1 is illustrated including an outer plastic housing constructed in accordance with the teaching of the present invention and generally adapted for use in engine starter circuits. The housing is formed with a hexagonal coil section 2 integrally formed to a mounting base or flange 3 on one end and an outwardly projecting rectangular contact section 4 to the opposite or upper end in the drawings. A pair of fixed power terminals 5, which can be any thread size and length, or other suitable electrical connecting device, are secured to the upper end wall of the contact housing section 4. A coil terminal 6, which can be any thread size and length or other electrical connecting device, is located on the mounting flange 3.

The solenoid housing is formed with an open bottom at the flange 3, which is closed by a metal mounting plate 7 having outwardly projecting mounting ears 8. The mounting plate 7 is connected to form the ground connection to an annular coil unit 9 mounted within the hexagonal coil section 2. An armature 10 in the form of a solid plunger or cylinder is slidably mounted within the coil section 9 for gravity movement to a lower position and moving in response to energization of the coil unit 9. A bridging contact unit or assembly 11 is located within the upper contact section 4 and includes a plunger 12 coupled to the armature 10 for vertical movement of the contact assembly. The fixed terminals 5 are exposed within the housing section 4 for selective engagement by the outwardly or upwardly moving bridging contact unit 11. The present invention is particularly directed to the housing and its interrelationship to coil unit 9 and contact unit 11 to provide a rugged, compact and reliable assembly which can be constructed at a reasonable cost.

The illustrated solenoid is adapted to be fixedly mounted to the block 13 or other common ground with respect to a gasoline engine-driven vehicle or the like, as by mounting bolts 14 passing through ears 8. The solenoid terminal 6 is adapted to be connected to an ignition starting circuit as by a lead 15 while the main power terminals 5 are adapted to be connected in series with the starter motor and the battery, not shown, as by leads 16, to provide a low current control of the high current circuit to the starter motor, not shown. Thus, energizing of the coil unit 9 results in the outward movement of the solenoid armature 10 into the solenoid coil unit 9 and the movement of the contact assembly 11 to bridge and close the connection of the power terminals 5. This of course completes the circuit to the starter motor in accordance with known ignition systems.

More particularly, the hexagonal-shaped coil section 2 is formed with the six side walls having opposed side walls spaced a distance corresponding to the external diameter of the annular coil assembly 9. The coil section 2 is also formed with a depth generally corresponding to the depth of the coil assembly 9.

The coil assembly 9 is an annular assembly including an outer cup-shaped can 17 formed of a suitable magnetic flux carrying material such as a conventional steel.

Figure 6:
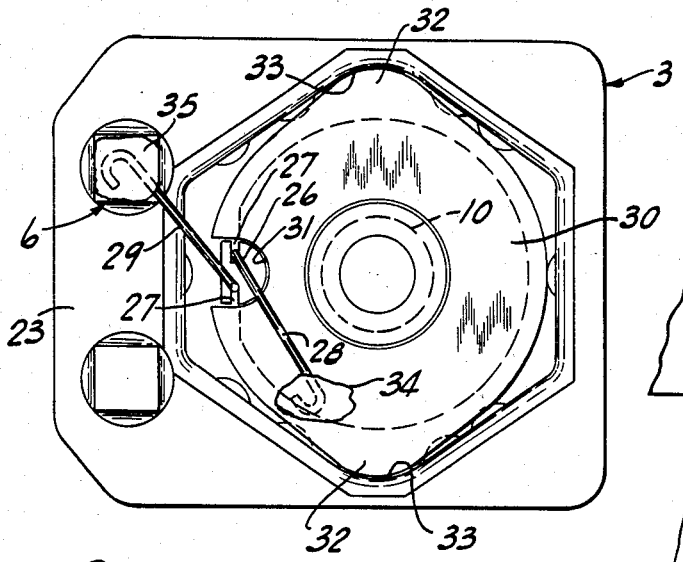
FIG. 6 is a horizontal section taken generally on line 6—6 of FIG. 4.

The outer can 17 has a depth generally corresponding to the depth of the section 2 and is assembled with the base 18 of the can abutting the inner ledge 19 defined by the common wall connection of the coil section 2 and the contact section 4. A suitable insulating bobbin 20, having a center tube and opposite end flanges 21 and 22, defines an annular recess within which the winding 23 is wound. The central tube includes an integral outward projection 24 which projects outwardly of the casing or can 17 and defines an elongated chamber within which the cylindrical armature 10 is slidably disposed. The lower flange 22 of the bobbin 20 includes a slight enlargement or projection 26 on the outer edge (FIG. 6). The projection 26 includes edge slots 27 through which the coil leads 28 and 29 extend for interconnection into a coil energizing circuit. A plate or disc 30 of a conductive metal and of a diameter substantially corresponding to that of the can 17 is located in abutting engagement with the bottom outer flange 22 of the bobbin and more particularly is in engagement with the outer end of the magnetic can 17. The plate 30 includes an edge recess 31 corresponding to the bottom projection 26. In the assembled relation, the plate recess 31 mates with the bobbin projection 26 to form an annular mechanical interlock therebetween. In addition, the clamping plate 30 includes opposite ear portions 32 extended outwardly of the principle diameter of the clamping plate. The opposed ear portions are located in the corner or connection of the hexagonal side walls of the housing section 2, as at 33. This assembly provides angular orientation of the coil assembly 9 within the housing section 2 in a given angular orientation and preventing angular movement within the housing. The coil 23 and its leads 28-29 are a relatively thin wire, and the integrity of the coil leads are maintained by minimizing movement of the coil assembly 9.

In the illustrated embodiment of the invention, the one lead 28 extends from the projection 26 and is electrically interconnected as by a soldered joint 34 to the exterior side of the clamping plate 30. The opposite lead 29 is extended from the enlargement outwardly to the external coil terminal 6 in the mounting base.

Figure 2:
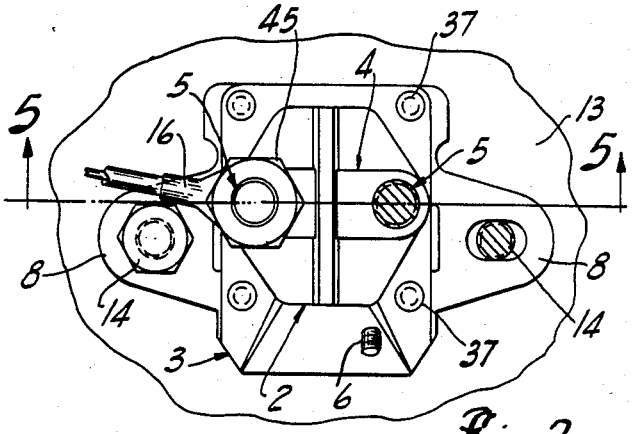
FIG. 2 is a plan view of the solenoids shown in FIG. 1.
Figure 3:
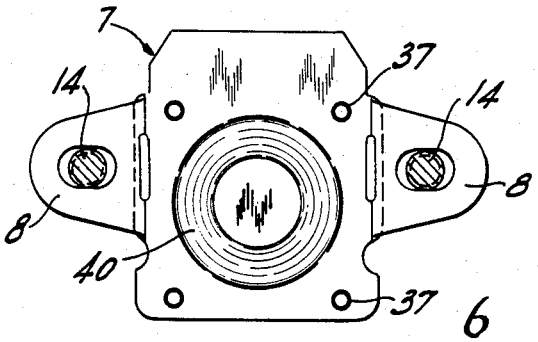
FIG. 3 is a bottom view of the solenoids shown in FIG. 1.
Figure 4:
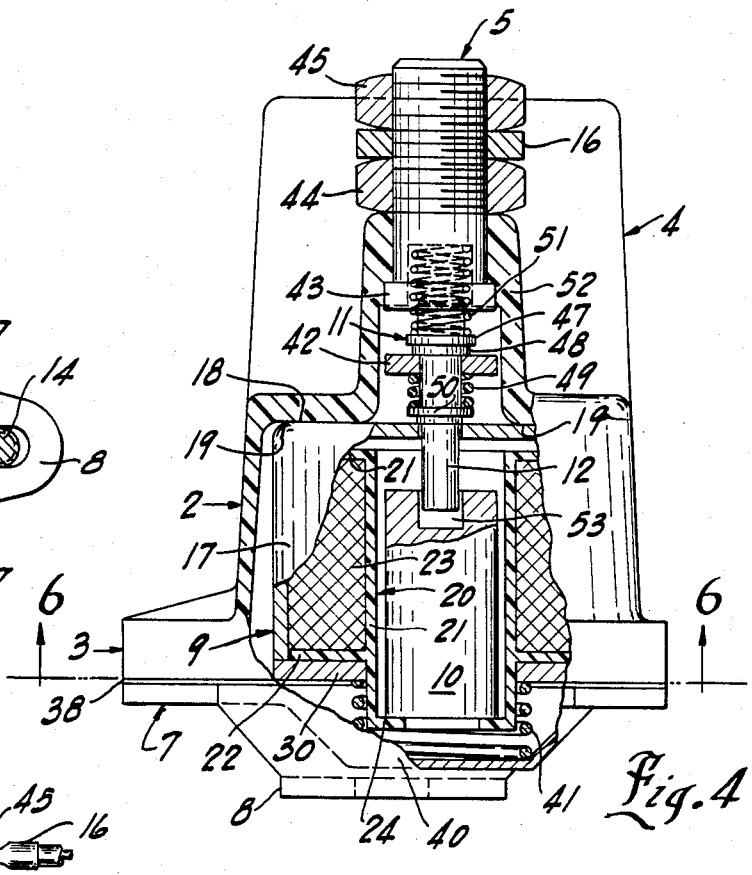
FIG. 4 is an enlarged transverse section taken generally on line 4—4 of FIG. 1 and clearly illustrating the internal construction of the solenoid.
Figure 5:
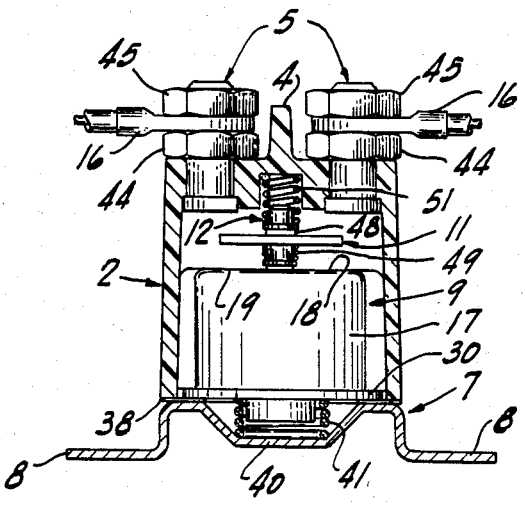
FIG. 5 is a transverse section taken generally along line 5—5 of FIG. 2.

The mounting base 3 of the housing is shown as a flat, rectangular portion with the opposite ends extending outwardly of the coil housing secton 2, as most clearly shown in FIG. 2. In the illustrated embodiment of the invention, the one coil terminal 6 is shown as a conventional threaded bolt-type member embedded within the flange 3 and having an inner flat-head 35 located within a rectangular recess within the flange 3. The coil lead 29 is extended through an edge recess within the undersurface of the flange 3 and is soldered to the head 35. The rectangular recess holds the terminal 6 against rotation when a clamping nut 36 is applied to the outer threaded end of the bolt.

The mounting plate 7 is a more or less conventional plate member having a flat rectangular portion suitably affixed to the mounting flange 3 as by four rivets 37 located on the four corners of the mounting plate and the mounting flange. The L-shaped mounting ears 8 are integral with the mounting plate and extend outwardly therefrom for convenient bolting thereof to the frame 13 of the vehicle or other implement. A sealing gasket 38 is preferably disposed between the mounting plate 7 and the housing flange 3 to provide a substantially liquid-tight seal of the housing, and particularly the coil unit 9 and the internal contact assembly 11.

The central portion of the mounting plate 7 is dished as at 40 to provide an outwardly projecting chamber of a lesser depth than the offset mounting ears 8. A coil spring 41 encircles the bobbin projection 24 and is compressed between the plate 30 and the recessed plate 7. The coil spring 41 functions to firmly clamp the coil unit 9 within the housing with the opposite end of the bobbin and cam 17 abutting the inner coil section wall 19. The coil spring 41 is constructed of a conductive metal and establishes electric connection of the coil plate 30 to the mounting plate 7. The plate 7 is connected to the coil lead 28 and provides direct connection of the coil 23 to the mounting plate 7 as a common circuit ground. The compressed spring 41 provides a reliable resilient mounting of the coil assembly 9 which minimizes movement of the coil assembly while maintaining a reliable circuit ground connection.

The contact assembly 11 in the preferred embodiment includes a rectangular bridging contact 42 formed of a highly conductive material such as copper. The bridging contact 42 is secured to the plunger 12 for selective positioning with respect to the fixed power terminals 5.

The power terminals 5 are relatively heavy highly conductive copper bolts. The inner head 43 of the bolt 5 is generally a rectangular portion with outer curved edges and mates with a corresponding recess in the outer end wall of the rectangular section. The terminal bolt is pressed in place and projects outwardly with a suitable clamping nut 44 for fixed mounting of the terminal in place. A power lead 16 is connected to the terminal by an outer connecting nut 45.

The contact housing section 4 has an internal rectangular cross-section with the longer length aligned with the power terminals 5.

The rectangular section 4 defines a guide opening extending outwardly of the end wall 19 of the coil section 2. The lateral or outer edges of the rectangular section 2 are preferably formed as generally curved shaped portions and as an extension of the hexagonal walls of the section 2 for esthetic considerations and convenience in molding, as shown in FIG. 2.

The contact assembly 11 includes the rectangular bridging contact 42 slidably disposed on the plunger 12, preferably formed of appropriate plastic material. The plunger 12 includes an enlarged clamping flange 47 adjacent the outer end. The contact 42 is located on the plunger 12 with small coil springs 48 and 49 located to the opposite faces of the contact. A holding washer 50 is press fitted or otherwisesecured to the plunger 12 to support the assembly with the springs compressed. The plunger 12 extends from such holding washer 50 and projects through the opening in the magnetic can 17 and into the solenoid armature 10. A bias stabilizing spring 51 is located between the outer end of the plunger 12 and the end wall 52 of the housing section 4 and resiliently urges the contact assembly 11 into engagement with the armature 10. The force of the spring 51 is sufficiently great to stabilize the location of the contact assembly.

The end wall of the rectangular section is a relatively heavy wall, with the inner surface recessed to accommodate the head of the terminal bolts 5 and with a separating insulating portion therebetween. The insulating section is also recessed to accommodate the small stabilizing spring 51 which acts between the base wall and plunger 12.

The armature 10 is a solid cylindrical member which is journaled in the tube of the bobbin. The armature moves within the tube 20 between the outer extension 24 and the inner base of the magnetic can 17. The can 17 includes a central opening through which the plunger 12 of the contact assembly 11 extends and into an aligned opening 53 in the end of the armature 10.

The armature 10 is of course formed of a suitable flux conducting material. Energization of the coil 23 creates an electromagnetic interaction with the armature 10 to move the armature upwardly toward the underside of the can 17. The movement of armature 10 correspondingly positions the contact assembly 11 for opening and closing the circuit assembly without unnecessary loading of the solenoid armature.

The coil assembly 9 and confining housing section 4 maintains proper alignment and positioning of the coil assembly 9 under the heavy vibration and shock forces. The construction contributes to a long operational life in the adverse environment of vehicles such as garden and lawn equipment, automobiles and the like. The present invention provides a highly reliable and long life solenoid unit particularly adapted for such application. The housing, the internal coil subassembly and contact subassembly are readily formed and assembled in mass production.

Figure 8:
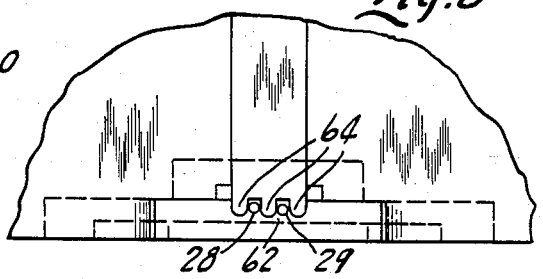
FIG. 8 is a vertical section taken on line 8—8 of FIG. 7.
Figure 9:
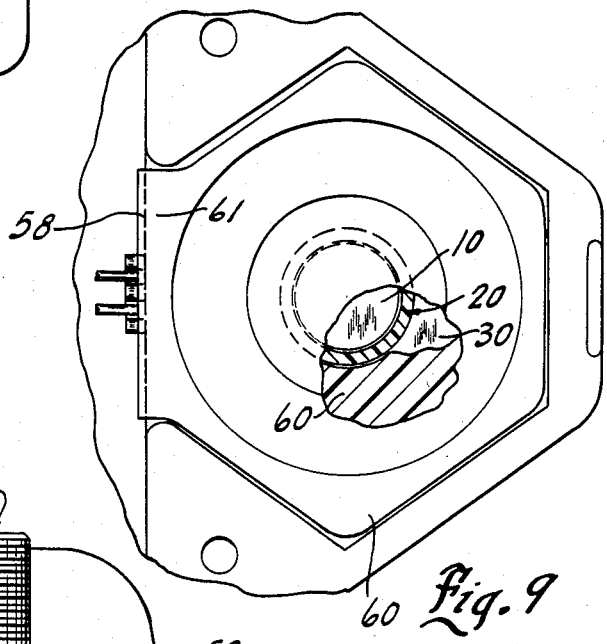
FIG. 9 is a bottom view of the housing with parts separated to more clearly illustrate the internal housing construction.
Figure 7:
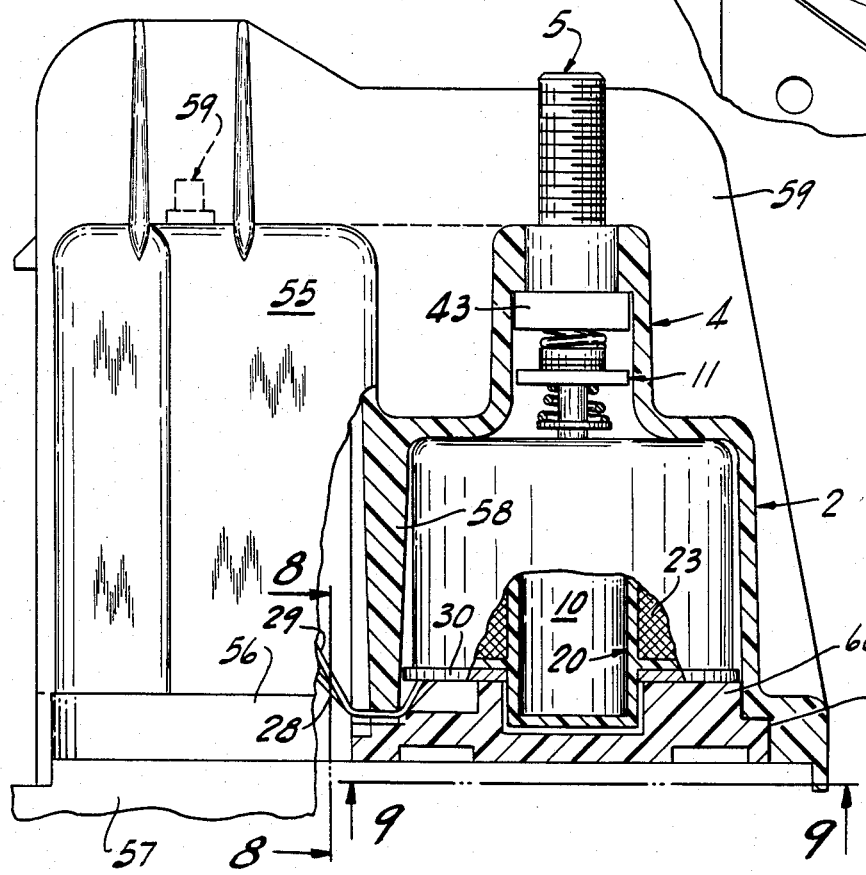
FIG. 7 is a view of an alternate embodiment of the present invention.

In the embodiment of FIGS. 1–6, the coil assembly is constructed and adapted for connection into circuit with the common ground connection. Where the common ground connection is not desired, the solenoid coil 23 is readily provided with an extra coil terminal in the vacant coil terminal location to the side of the illustrated coil terminal 6 and with the common lead 28 correspondingly projected through the housing to the terminal, as shown in phantom in FIG. 1. In the construction where the common ground is not employed, it may be desirable to provide a separate closure plate or sealing of the lower end of the housing. A particular application of a solenoid unit applied to an integrated control system for small engines or the like is illustrated in FIGS. 7–9. The coil assembly, contact assembly and the basic housing structure in the second embodiment are similar the first embodiment. Elements of the second embodiment which correspond essentially to the first embodiment are therefore correspondingly numbered, and the differences of the second embodiment are described in detail as follows.

In the second embodiment, the solenoid unit includes a similarly shaped housing having a hexagonal coil section 2 and the generally rectangular contact section 4. The solenoid housing is integrally molded with a rectangular circuit housing 55 with a common base 56 to which a mounting plate 57 is affixed. The coil leads 28 and 29 are connected into the circuit through a circuit board, not shown, within the housing 55. The base 56 is shown modified without the coil terminal portion and forming a common open bottom wall with the solenoid housing.

The illustrated circuit housing 55 is slightly wider than the width of the solenoid housing and is shown integrally formed with one side wall of the hexagonal solenoid section 2 as a common wall 58 therebetween. The terminal separating wall 59 between the power terminals 5 extends laterally onto the rectangular housing 55 and include a lateral plate extending across a spade-type terminal assembly 59. The contact section is also shown provided with integral interconnecting walls connected to the circuit housing.

The contact section 4 thus otherwise generally is essentially the same as that previously described with the power terminals correspondingly secured therein. The contact assembly 11 and the coil assembly 9 are also similarly formed and located within the respective housing sections.

In the second embodiment of the invention, solenoid coil 23 is not grounded to the plate 30, but the leads 28–29 extend into the housing 55 through the base.

The base of the solenoid housing is recessed to receive a plastic insulating cover 60. The recess and cover are formed of a hexagonal configuration, with the cover including an extension 61 over the common wall 58. The cover 60 is shown as a simple plastic molded member.

The interface of the cover 60 at the common wall is formed with a recess 62 which engages three complementing projections 64 on the common wall 58 between the circuit housings. Thus, the common wall is recessed or removed in the base portion. The coil leads 28–29 extend directly from the coil 23 between the projections 64 into the housing 55 for circuit conection. The cover recess 62 is stepped and aligned with the recesses between the projections 64. Thus, when the plastic cover 60 is secured in place, it firmly clamps the leads 28–29 to the projections within the separating wall to firmly hold the leads in a fixed position.

The cover 60 can be sealed, as by a suitable adhesive 66 to provide a sealed chamber for the coil assembly with the coil leads projecting therefrom. Alternatively, the bottom cover can be secured in place by interconnection of the mounting plate which is riveted or otherwise secured to close the solenoid housing and the circuit housing.

Thus the second embodiment essentially corresponds to the first embodiment with the modified closure of the housings and the clamping of the leads in position for direct circuit connection.

Various modes in carrying out the invention are contemplated as being within the scope of the following claims, particularly pointing out and distinctly claiming the subject matter which is regarded as the invention.

I claim:

1. A small compact solenoid unit for use in a vibrating and shock environment, comprising a hollow cup-shaped housing having an open end and including a coil section having a plurality of linear side walls adjacent to the open end and terminating in an inner lateral clamping wall, said housing having a substantially rectangular housing section extending outwardly of said clamping wall and forming a rectangular chamber as an extension of said coil section, said rectangular housing section including a closed end wall, a pair of power terminals secured in said end wall and projecting outwardly therefrom and having inner contacts within said rectangular housing, an annular solenoid coil unit disposed in said coil section including an annular coil and an armature in said coil and including a coil plate abutting the underside of the coil unit, said coil plate engaging said linear side walls and being configured and constructed to prevent rotation of said plate within said housing, said coil unit having interlocking means coupled to said plate to prevent relative rotation therebetween, said coil unit having coil leads extended from said coil to terminal connections, a floating contact unit having a bridging contact slidably mounted in said rectangular housing chamber and guided by the walls of said housing for movement with respect to said inner terminal contacts, said bridging contact being resiliently disposed on an insulating plunger extending into said coil unit and positioned by relative movement of said armature.

2. The solenoid apparatus of claim 1 wherein said housing includes an open bottom wall having a recessed ledge of a configuration essentially corresponding to a cross-section of said coil section, an insulating cover located within said recessed ledge and secured therein to clamp said coil unit in place, said coil having leads extending outwardly through an edge opening in said recessed ledge and clamped in place by sald cover.

3. Solenoid of claim 1 wherein a metal mounting plate is secured to the open end of said housing and serves to close said housing, said plate having laterally extending mounting ears, a coil spring acting between said coil plate and said mounting plate to resiliently clamp said coil unit in said coil section, said coil unit including a common terminal extended from the coil and interconnected to said coil plate and electrically connected by said coil spring to said mounting plate.

4. The solenoid of claim 3 wherein said coil unit includes an insulating member abutting said coil plate and said insulating member and coil plate having said interlocking means to hold said coil unit against angular movement.

5. The solenoid of claim 4 wherein said insulating member includes an interlocking enlargement having slots through which said coil leads extend.

6. A solenoid for connecting an electric starter of an internal combustion engine to a battery power supply, comprising a plastic housing molded in a generally open-ended cup-shape, said housing having a mounting flange at the open end and a coil section extending from said mounting flange and a contact section extending from said coil section, a cylindrical coil assembly located within said coil housing section and including an annular bobbin with a cylindrical coil wound on said bobbin, said bobbin defining a central opening, an armature axially sliding in said central opening, an outer magnetic can formed of a magnetic material and having a base abutting an inner wall of said coil section, said coil wound bobbin being disposed in said can, said coil section being formed as a hexagonal configuration having opposed parallel side walls defined by common junctions defining generally V-shaped corners, a coil plate abutting the underside of said bobbin and said can and including a pair of lateral projections aligned with the corners of said intersecting walls of said hexagonal shaped coil section.

7. The solenoid of claim 6 wherein said contact section includes an end wall and being generally rectangular in configuration and defining an internal rectangular chamber, contact bolts secured in said end wall of said rectangular section and including an outer threaded bolt portion and an inner head contact, a movable contact assembly including a conductive rectangular plate defining a contract slidably disposed in said rectangular chamber and guided for movement therein by the housing walls for selectively completing the circuit between said fixed contacts.

8. The solenoid of claim 7 wherein said movable contact assembly includes an axial pin extending through said contact and having spring means located to the opposite sides of said contacts and abuttments on said pin to resiliently mount the contact, said pin extending from said rectangular chamber through a central opening in the can into engagement with said armature, a coil spring extending between the pin and said end wall of the rectangular section to resiliently urge the movable contact assembly into engagement with the armature.

9. The solenoid of claim 6 having a projection and enlargement on said bobbin and said coil plate to angularly lock the bobbin in location with respect to said coil plate, means secured to the open end of said housing to clamp said coil assembly within said coil section.

10. A solenoid unit for use in a vibrating and shook environment, comprising a plastic molded housing molded in a cup-shape having an open end, said housing having a mounting flange at the open end and a coil section extending from said mounting flange to an inner wall of said coil section and having an integral contact section extending from said coil section, a coil unit located within said coil section and including a cylindrical coil and an armature slidably mounted within said coil, an outer magnetic can formed of a magnetic material and having an outer based portion located abutting said inner wall of said coil section, said can having a bottom coil plate adjacent said open end, said coil plate and said housing having an interlocking means in the form of a ear and corner to positively support said coil unit and prevent rotational movement of said coil unit within said housing.

11. The solenoid of claim 10 wherein said coil section being formed with a plurality of straight wall portions defining said corner adjacent said open end of said magnetic can, and said coil plate having said ear mating with said corner and thereby forming said interlocking means.

12. The solenoid unit of claim 10 including a contact assembly having a terminal bolt including a inner head having at least one flat edge, a nut threaded onto said bolt for securing of a conductor to said bolt, said contact section having a corresponding flat wall aligned with and abutting said flat edge, said abutting flat edge and wall defining a stop means positively preventing rotation of said bolt in response to the threading of said of nut onto said bolt.

13. The solenoid unit of claim 10 wherein said coil include leads extended outwardly between said bottom cover and the open end of said housing, said leads being extended outwardly in spaced relation and being clamped between the housing and said cover.

* * * * *

UNITED STATES PATENT AND TRADEMARK OFFICE

CERTIFICATE OF CORRECTION

PATENT NO. : 4,521,758

DATED : June 4, 1985

INVENTOR(S) : Larry J. Krubsack

It is certified that error appears in the above-identified patent and that said Letters Patent is hereby corrected as shown below:

Col. 5, line 51, After "outwardly of the" insert ---common---; Col. 5, line 64, Cancel "otherwisesecured" and substitute therefor ---otherwise secured---; Claim 2, col. 8, line 30, After "place by" cancel "sald" and substitute therefor ---said--- Claim 10, col. 9, line 28, cancel "shook" and substitute therefor ---shock---

Signed and Sealed this

*Sixth* Day of *May 1986*

[SEAL]

*Attest:*

DONALD J. QUIGG

*Attesting Officer*

*Commissioner of Patents and Trademarks*